US006296341B1

(12) United States Patent
Sugahara

(10) Patent No.: US 6,296,341 B1
(45) Date of Patent: Oct. 2, 2001

(54) METHOD FOR REGULATING INK DROPLET DRIVE CONTROL IN INK JET PRINT HEAD

(75) Inventor: Hiroto Sugahara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/298,177

(22) Filed: Apr. 23, 1999

(30) Foreign Application Priority Data

Apr. 24, 1998 (JP) ..... 10-114981

(51) Int. Cl.[7] ..... B41J 29/393; B41J 29/38; B41J 2/205; B41J 2/14; B41J 2/165

(52) U.S. Cl. ..... 347/19; 347/11; 347/12; 347/14; 347/15; 347/49; 347/23

(58) Field of Search ..... 347/19, 49, 12, 347/14, 23, 11, 15; 395/113, 108, 109

(56) References Cited

U.S. PATENT DOCUMENTS 4,491,851 * 1/1985 Mizuno et al. ..... 347/19
5,212,497 5/1993 Stanley et al. .
5,363,134 * 11/1994 Barbehenn et al. ..... 347/49
5,502,468 3/1996 Knierim ..... 347/19
5,550,956 * 8/1996 Tadokoro ..... 347/19

FOREIGN PATENT DOCUMENTS

A 5-185589 7/1993 (JP) .
A-7-32651 2/1995 (JP) .

* cited by examiner

*Primary Examiner*—Thinh Nguyen
*Assistant Examiner*—Charles W. Stewart, Jr.
(74) *Attorney, Agent, or Firm*—Oliff & Berridge, PLC

(57) ABSTRACT

A drive regulation method for an ink jet print head, wherein a plurality of ejection signals are prepared for driving an ink jet print head in various states. The ink jet print head is controlled to eject ink based on each of the selected signals. The ejection signal that achieves the most stable ejection aim from each of the nozzles is used as the ejection signal for that ink jet print head. In order to determine which of the ejection signals achieves the best result, dot arrays are printed on a recording medium for each ejection signal and the recorded dot arrays are examined for degree of unevenness. The ejection signal that achieves the most even dot array is selected. The ejection signals selected for each ink jet print head are stored in a memory device.

10 Claims, 5 Drawing Sheets

METHOD FOR REGULATING INK DROPLET DRIVE CONTROL IN INK JET PRINT HEAD

BACKGROUND OF THE INVENTION

The present invention relates to an ink jet print head provided in an ink jet type recording device, and more particularly, to a method for improving the reliability and accuracy of ink droplet ejection from an ink jet print head by regulating the drive signals that effect ink droplet ejection.

Some conventional ink ejection devices employ a piezoelectric ceramic element to alter the capacity of an ink chamber containing ink. An ink droplet is expressed from the ink chamber through an associated nozzle when the capacity of the ink chamber is decreased, and ink is introduced into the ink chamber through an ink inlet when the capacity of the ink chamber is increased. This type of ink jet print head is formed with a plurality of ink chambers. The ink chambers are separated by partitions formed of a piezoelectric ceramic material. An ink supply device, such as an ink cartridge, is connected in fluid communication on one end of the plurality of ink chambers, while ink ejection nozzles (hereinafter abbreviated to nozzles) are provided on the other end of the plurality of ink chambers. When drive signals are applied to the partition walls, the partition walls are deformed. This deformation decreases the capacity of the interposed ink chamber and generates a pressure wave in the ink that forces an ink droplet to be ejected through the associated nozzle onto a recording medium, forming characters, patterns, and the like.

If variations exist in the dimensions of the ink chambers or nozzles, however, the ink droplets cannot be reliably ejected from the nozzles in an accurate direction, even when the ink jet print head is driven by a regulated drive waveform. This is evident when unevenness appears in dot arrays recorded on the recording medium and when the recording device cannot achieve a prescribed recording quality.

The consistency of this ink droplet ejection is dependent on both the time required for the pressure wave generated in the ink to propagate once across the length of the ink chamber and the pressure wave generated by the drive waveform. These two factors cannot be coordinated if variation exists in the dimensions of the ink chambers. As a result, the ink droplets cannot be reliably ejected with an accurate aim. Due to this problem, it is necessary to require extremely strict tolerances for the dimensions of the ink chambers and nozzles during the production process in order to maintain a uniform printing quality for each ink jet print head.

According to the method proposed in Japanese Laid-Open Patent Application (Kokai) No. HEI-7-32651, a plurality of test images is recorded on a recording medium, and the density of these test images is measured using an optical scanner. Next, a characteristic curve is graphed using the measured density and drive control values. The characteristics of each ink jet print head are optimized by calculating the optimal value of the derived control values for each ink jet print head based on the characteristic curvature, test results, test control values, and desired density. However, this method of calculating the optimal drive control value is not efficient because it requires a large number of processes. In addition, the above process does not consider the consistency of the ink droplet ejection direction, which has a major effect on the recording quality. Accordingly, this process is not sufficient for reliably achieving and maintaining a prescribed printing quality.

SUMMARY OF THE INVENTION

In view of the foregoing, it is an object of the present invention to provide a drive regulation method for an ink jet print head capable of maintaining a uniform recording quality for each ink jet print head without requiring a strict tolerance in the production process.

These and other objects of the present invention will be attained by a method for regulating ink droplet drive control in an ink jet print head, wherein an ejection signal is applied to an actuator provided in the ink jet print head to eject ink stored in an ink chamber through an associated nozzle. In this method, a plurality of signal types are preselected for driving the ink jet print head under a variety of conditions. From these preselected ejection signals, the ejection signal most capable of stabilizing the directions in which the ink ejects from the nozzles is employed as the ink jet ejection signal to drive the ink jet print head. The type of ejection signal selected from the plurality of preselected types is determined based on experience and testing taking variations in the dimensions of the ink chambers and nozzles into consideration. With this method, a plurality of ejection signals are preselected for driving each of the ink jet print heads under various conditions, and the ink jet print head is driven based on the selected ejection signal. Subsequently, the ink ejection signal most capable of stabilizing the direction in which ink droplets are ejected from the nozzle is used as the ink jet print head ejection signal. Therefore, each ink jet print head can be driven with a different ejection signal. As a result the direction in which ink droplets are ejected from the nozzle is stabilized for each ink jet print head even when inconsistencies exist from the manufacturing process, making it possible to achieve a uniform printing quality. Further, this method is beneficial for mass production, as the process requires only selected an ejection signal for each ink jet print head from a plurality of preselected signals.

Preferably, an ejection signal is selected by examining the unevenness or distortion in the dot array recorded on the recording medium to determine whether the direction of ink ejection has been stabilized or not. That is, the direction in which ink is ejected from the ink jet print head is determined to be more consistent when less distortion is found in the dot array recorded on the recording medium. Therefore, the invention provides an easy method for determining whether the aim of each nozzle has been optimized.

Preferably, the actuator is provided on one side of the ink chamber for generating a pressure wave in the ink based on the ejection signal. Further, the plurality of ejection signals are configured of pulse signals that differ in pulse width. With this construction, ink ejection is stabilized when the pulse width of the ejection signal has a prescribed relationship with the time required for the pulse width to propagate one way in the lengthwise direction of the ink chamber. In this way, an ejection signal having an optimal pulse width can be selected from the plurality of ejection signals.

Preferably, each of the ejection signals is a combination of a primary pulse having pulse widths different from each other and an auxiliary pulse having a timing and a pulse width capable of substantially dampening or offsetting meniscus vibrations caused by the primary pulse. With this construction, ink is ejected according to the primary pulse, after which the auxiliary pulse is used to substantially cancel the meniscus vibrations resulting from the primary pulse. If meniscus vibrations are appropriately dampened at this time, then the direction in which the next ink droplet is ejected will be stabilized. Accordingly, an ejection signal having an optimal primary pulse and auxiliary pulse is selected from the plurality of ejection signals for stabilizing the direction in which ink droplets are ejected from the ink jet print head.

Preferably, the plurality of preset ejection signals are configured by varying the primary pulse width, the auxiliary pulse width, and the interval between the two pulse widths at a uniform proportion. Accordingly, this method enables or simplify selection of the plurality of ejection signals.

Preferably, a memory device is integrally provided on the ink jet print head for storing data corresponding to the selected ejection signal. With this construction, during the actual recording operations, the ink jet print heads can be controlled to eject ink droplets based on the data stored in this memory device, thereby stabilizing the direction at which ink droplets are ejected.

Preferably, the recording device includes a plurality of ink jet print heads, and the drive regulation method is performed for each ink jet print head. With this construction, drive regulation is performed for each of the plurality of ink jet print heads, and a drive signal is determined for each ink jet print head. Accordingly, a uniform printing quality can be maintained for each ink jet print head in a multicolor printing device and the like, and the relative dot positions of different colors can be accurate on the recording medium, thereby achieving a high printing quality.

DETAILED DESCRIPTION OF THE PREFERRED EMBODIMENT

A method for regulating ink droplet drive control in an ink jet print head according to a preferred embodiment of the present invention will be described while referring to the accompanying drawings.

Figure 1:
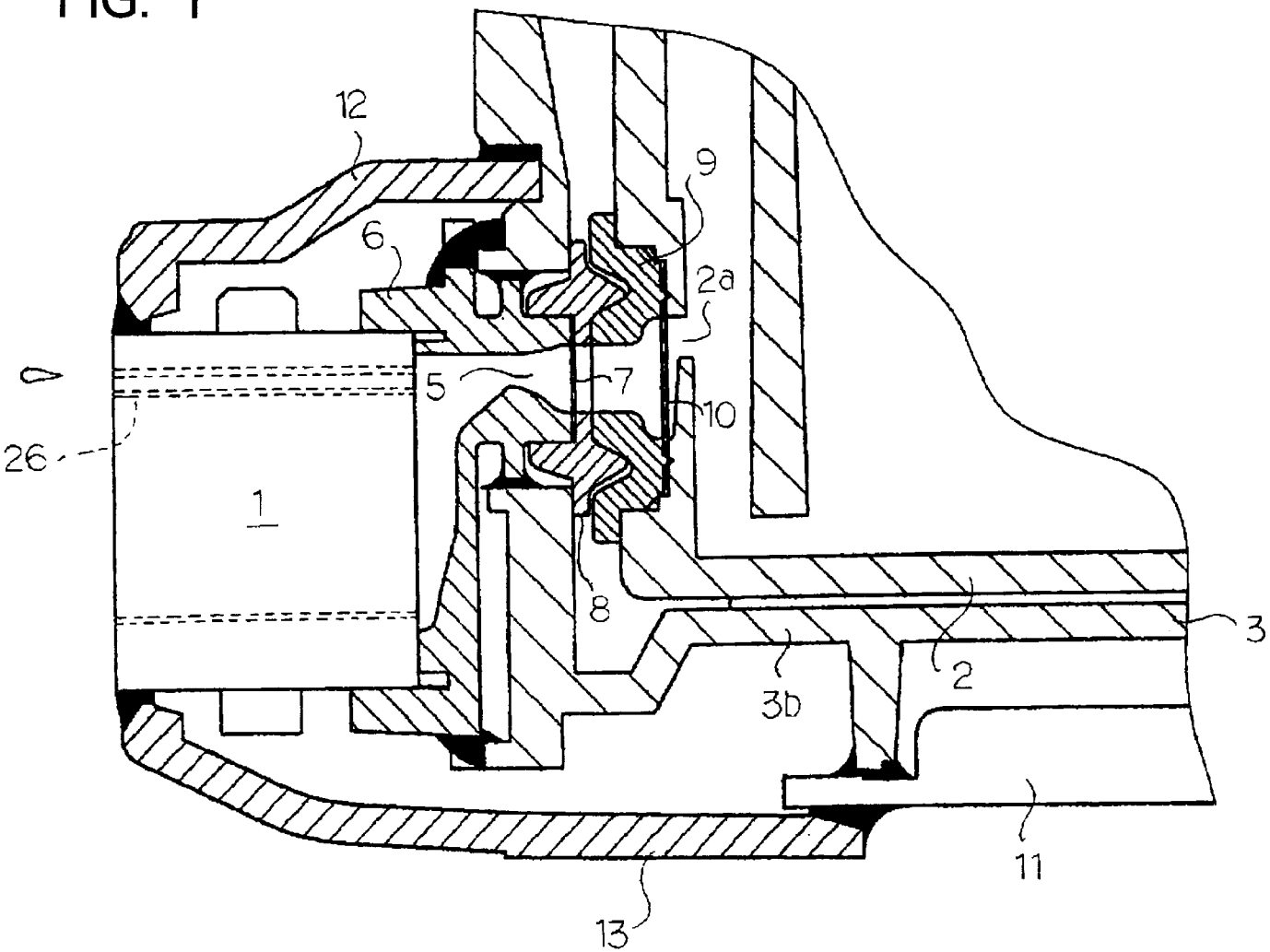
FIG. 1 is a cross-sectional view showing the relevant portion of an ink jet recording device with an ink jet print head according to one embodiment of the present invention.

In FIG. 1 an ink jet print head 1 ejects ink droplets onto a recording medium (not shown) to record images. The ink jet print head 1 contains a plurality of ink chambers 26. The ink chambers 26 will be described in more detail later.

An ink cartridge 2 is provided for storing ink and providing the same to the ink jet print head 1 via an ink outlet 2*a*. A manifold 6 is connected in fluid communication to the rear ends of the ink chambers 26. An ink supply inlet 5 of the manifold 6 is connected in fluid communication with the ink outlet 2*a* of an ink cartridge 2 by means of joint members 8 and 9. A filter 7 and a filter 10 are provided between the ink supply inlet 5 and joint member 8 and the joint member 9 and ink outlet 2*a,* respectively. The manifold 6 serves to distribute ink from the ink cartridge 2 to the plurality of ink chambers 26.

The ink jet print head 1 is fixedly supported along with the manifold 6 on the holder member 3. The holder member 3 is detachably mounted on a carriage (not shown) well known in the art. The carriage is capable of moving back and forth in the widthwise direction in relation to a recording medium. In addition, a top cover 12 and a bottom cover 13 are provided on the upper and lower sides of the ink jet print head 1 and manifold 6.

As will be described later, a ROM memory device 11 is provided on a bottom portion 3*b* of the holder member 3. The ROM memory device 11 stores data corresponding to a drive waveform that is used, as an ejection signal, to effect ejection of ink droplets from the ink jet print head 1. With this construction, characteristic data for the ink jet print head 1 is integrally mounted with the ink jet print head 1 on the carriage. Accordingly, when the ink jet print head 1 is set in the ink jet recording device, a control unit in the recording device reads data stored in the ROM memory device 11. Based on this data, the control unit outputs the ejection signal to drive the ink jet print head 1, which ejection signal has a suitable drive waveform to maintain a desired recording quality.

Figure 2:
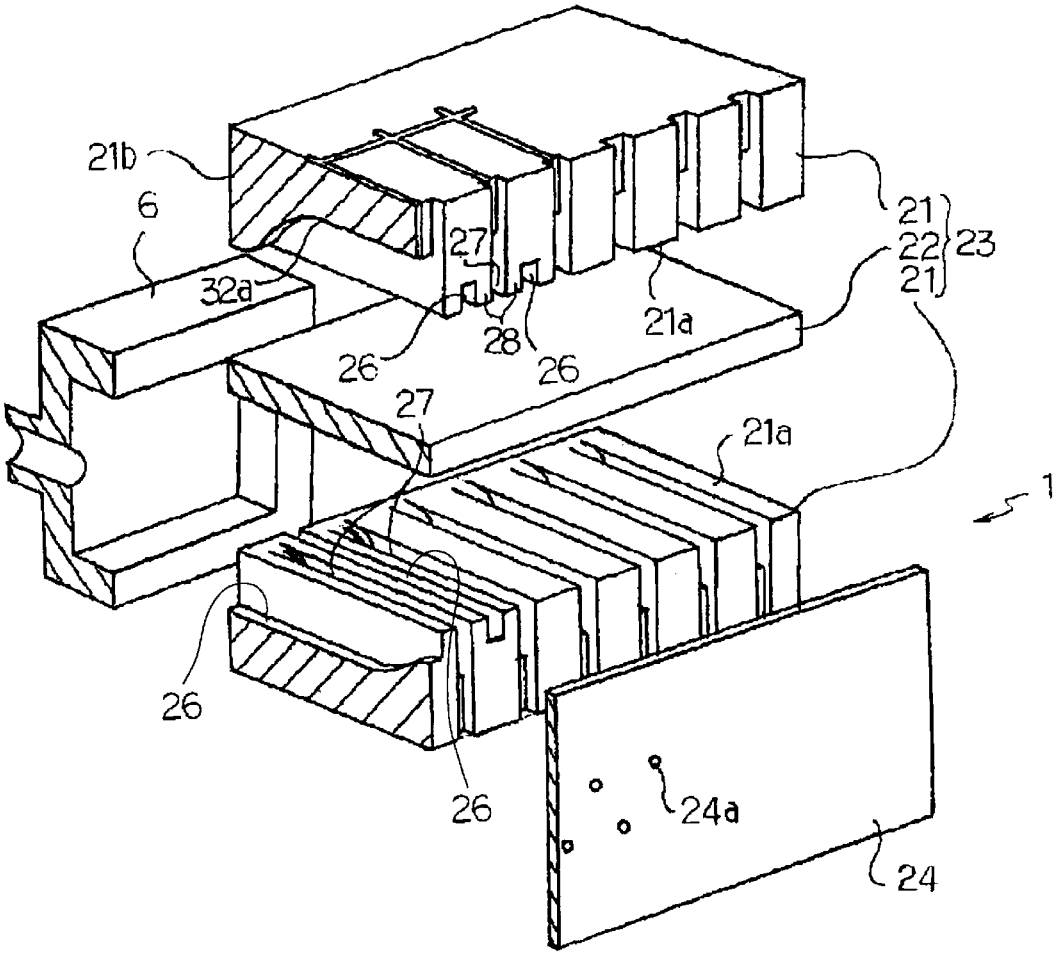
FIG. 2 is an exploded perspective view of the ink jet print head according to the embodiment.
Figure 3:
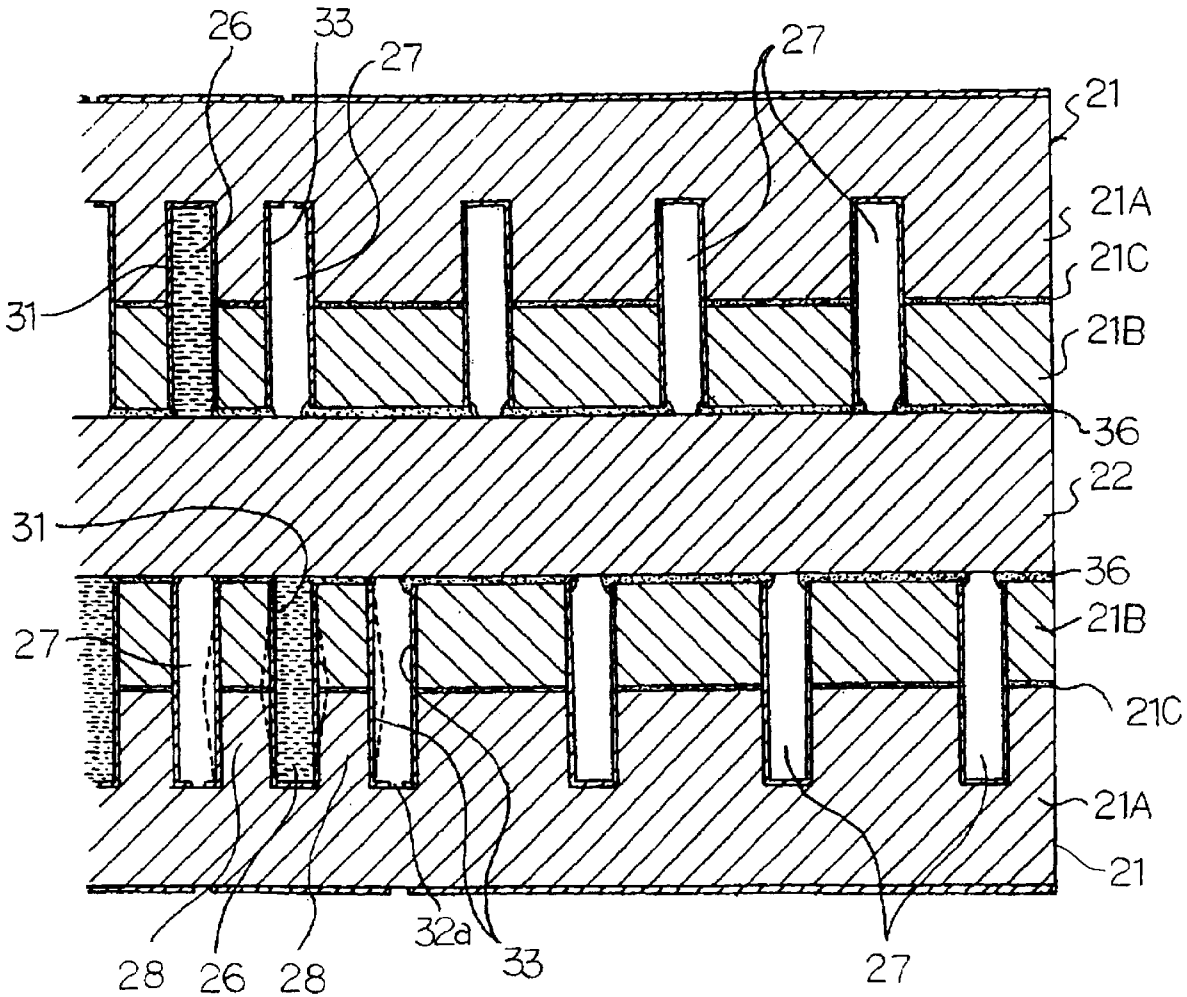
FIG. 3 is an explanatory diagram showing the operations of the ink jet print head according to the embodiment.

As shown in FIG. 2, the ink jet print head 1 includes an actuator member 23 and a nozzle plate 24. The actuator member 23 is formed with a pair of actuator boards 21 and a plate member 22 interposed between the actuator boards 21. The actuator boards 21 and plate member 22 are joined together by an adhesive 36 (FIG. 3). The nozzle plate 24 also is joined to the front end of the actuator member 23 by an adhesive. The manifold 6 is joined on the back end of the actuator member 23.

As shown in FIG. 3, the actuator boards 21 are constructed of piezoelectric layers 21A and 21B, which are formed of lead zirconate titanate (PZT) ceramic material. The piezoelectric layers 21A and 21B are joined together by adhesive layers 21C. The piezoelectric layers 21A and 21B are polarized in opposite directions to each other in the thickness direction of the actuator boards 21. The plurality of ink chambers 26 and a plurality of dummy spaces 27 are provided in the surfaces 21*a* (see FIG. 3) of the actuator boards 21. These ink chambers 26 and dummy spaces 27 are formed alternately and parallel to each other in the actuator boards 21. They are deep enough to penetrate each layer of the actuator boards 21. Each of the ink chambers 26 penetrates both front and back ends of the actuator boards 21. However, the dummy spaces 27 are closed to the manifold 6 by a back surface 21*b* of the actuator boards 21. The nozzle plate 24 is formed with a plurality of nozzles 24*a* at positions corresponding to the ink chambers 26.

Electrodes 31 and 33 are formed on the inner surfaces of the ink chambers 26 and dummy spaces 27, respectively. An electrode 33 is provided on each side surface of the dummy spaces 27. Each electrode 33 provided in one dummy space 27 is separated from the other by a groove 32*a*. A partition 28 is formed one on each side of the ink chambers 26.

One pair of partitions 28 containing an ink chamber 26 therebetween forms an actuator with the electrodes 31 on the inner sides of the same partitions 28 and the electrodes 33 on the outer sides of the same partitions 28. A drive voltage is applied to the electrodes 33 on the outer surfaces of the partitions 28 while the electrodes 31 on the inner surfaces of the ink chamber 26 between the pair of partitions 28 are grounded. This action generates a field orthogonal to the polarized direction of the piezoelectric material on the inner portions of the partitions 28, causing the partitions 28 to deform in the direction shown by the curved dotted lines in FIG. 3. The deformation causes the capacity of the ink chamber 26 to change, ejecting ink from the ink chamber 26 through the nozzle 24*a*.

Next, the ejection operation will be described with reference to FIGS. 4 and FIGS. 5(*a*) through 5(*d*).

In the ejection operation, the control unit (not shown) of the recording device reads data for the drive waveform stored in the ROM memory device 11 and applies an ejection signal corresponding to this data to the electrodes 33 of the partitions 28. As shown by the broken line in FIG. 3, when the signal is applied, each of the partitions 28 deforms in shear mode, increasing the capacity of the ink chamber 26. At this time, the pressure in the ink chamber 26 decreases. This drive voltage is maintained only for a time T required for a pressure wave to propagate one way in the lengthwise direction of the ink chamber 26. According to the theory of pressure wave propagation, when a time T has elapsed after the drive voltage was first applied, the pressure wave within the ink chamber 26 inverts from a negative pressure to a positive pressure. By returning the voltage applied to the electrodes 33 to zero after the time T has elapsed, the partitions 28 will return to their rest state before deformation, adding pressure to the ink. Hence, at this time pressure caused by the pressure wave inverting to a positive pressure is added to the pressure generated by the partitions 28 returning to their rest state. Therefore, a relatively high pressure is generated near the nozzle 24*a* of the ink chamber 26, causing an ink droplet to be forced out of the nozzle 24*a*.

As mentioned above, the time T is the time necessary for a pressure wave generated in the ink chamber 26 to propagate one way across the length of the same. Therefore, if "L" is the length of the ink chamber 26, and "a" is the sonic speed that sound travels in the ink of the ink chamber 26, then time T can be calculated with the expression T=L/a.

However, the pressure within the ink chamber 26 continues to fluctuate for a period of about 2T following ejection of the ink droplet. As a consequence, the meniscus (curvature formed on the ink surface) in the nozzle 24*a* continues to vibrate. Hence, when the next ink droplet is ejected the vibrations of the meniscus interfere with the ejection, reducing the accuracy of the ink droplet aim or in some cases preventing ejection from occurring.

Figure 4:
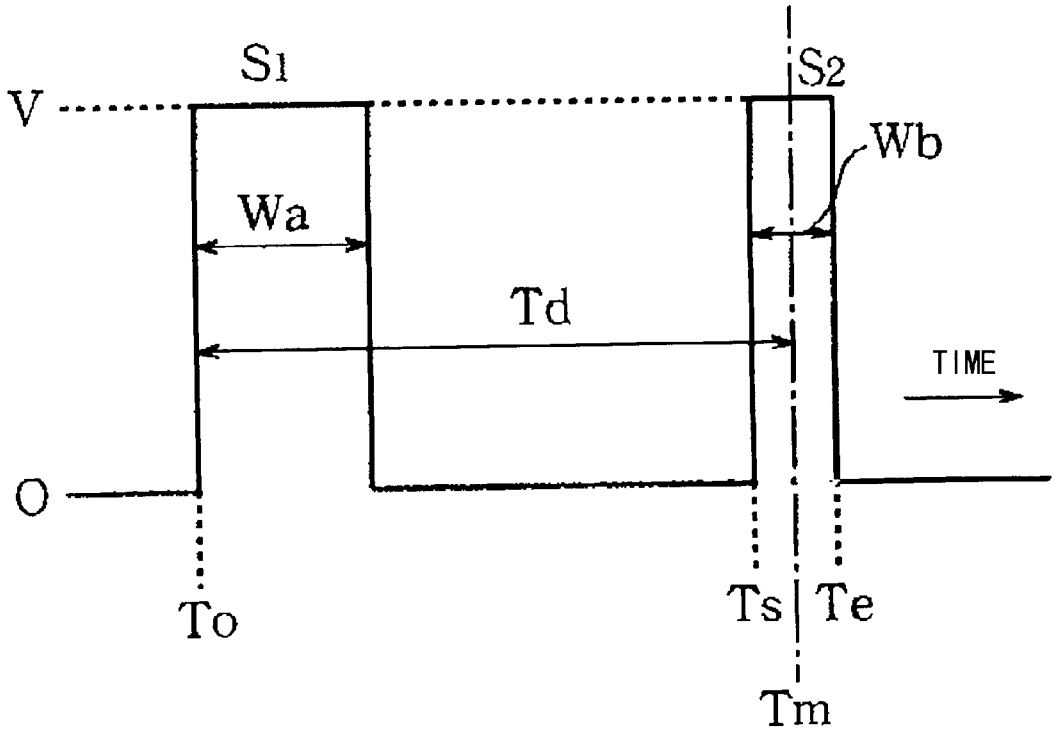
FIG. 4 is an explanatory diagram showing an waveform of an electrical pulse applied to the ink jet print head according to the embodiment.

To resolve this problem, the ejection signal contains both a primary pulse S1 for ejecting an ink droplet and an auxiliary pulse S2 having a suitable timing and pulse width to substantially dampen the meniscus vibrations resulting from the primary pulse S1, as shown in FIG. 4. The wave height (voltage value) is V for both the pulse S1 and pulse S2. The width Wa of the primary pulse S1 is approximately equal to the propagation time T or an odd multiple thereof. When the meniscus moves in the external direction, the auxiliary pulse S2 rises to cancel this meniscus by enlarging the capacity of the ink chamber. Subsequently, when the meniscus begins moving back in the inward direction of the ink chamber, the auxiliary pulse S2 drops to cancel further the meniscus by returning the ink chamber to its original capacity. In the example of FIG. 4, the width Wa of the primary pulse S1 is equal to the time T. Here, the primary pulse S1 begins to rise at a timing To. A timing Tm marks the halfway point between the start timing Ts and the end timing Te of the auxiliary pulse S2. A delay time Td from To to Tm is equal to 3.5 times the propagation time T, and the pulse width Wb of the auxiliary pulse S2 is equal to 0.5 times the propagation time T.

As described above, an ink droplet is ejected when the primary pulse S1 is applied. Subsequently, the advancement of the meniscus is suppressed at a timing Ts by the rise of the auxiliary pulse S2. Next, the retreat of the meniscus is restrained at a timing Te by the drop of the auxiliary pulse S2, effectively dampening the meniscus vibration.

In this way, if the pulse widths Wa and Wb of the ejection signal conform to a prescribed relationship with the time T, ink droplets can be ejected without being affected by meniscus vibrations caused by the previous ejection. Accordingly, the direction of the ejection is stabilized, enabling the recording device to achieve a uniform recording quality. As described above, however, if variations exist in the dimensions of the ink chambers 26 and nozzles 24*a* of the ink jet print head 1, the direction in which ink is ejected may be affected by the meniscus vibration created by the previous ejection. If the ejected aim of the ink droplets becomes unreliable, unevenness will appear in the dot arrays printed on the recording medium.

Next, a method for regulating ink droplet drive control in an ink jet print head. This method is capable of compensating for variations in dimensions of the ink chambers 26 and nozzles 24*a* that can lead to variations in the direction that ink droplets are ejected from the ink jet print head 1.

[First Step]

In the first step, a plurality of ejection signals are preselected for driving the ink jet print head 1 in various states. Here, the plurality of ejection signals are configured of various electrical pulse signals each having a different pulse width. Each ejection signal is formed of a primary pulse different from each other and an auxiliary pulse containing a timing and pulse width for substantially canceling the meniscus vibration created by the primary pulse. The types of ejection signals are selected based on experience and testing taking variations in the dimensions of the ink chambers and nozzles into consideration.

Figure 5:
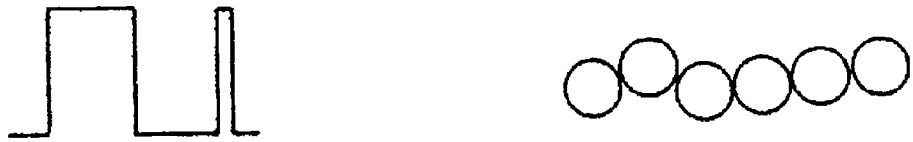
FIGS. 5(*a*) through 5(*d*) show various examples showing the relationship between ejection signals having waveforms different from one another and dot arrays formed under the respective ejection signals.
Figure 5:
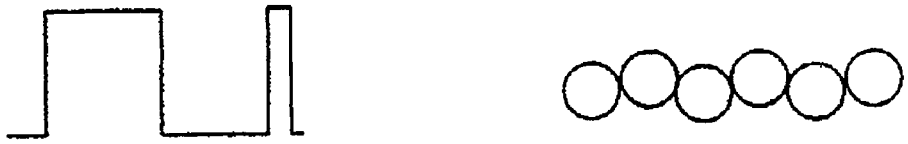
Figure 5:
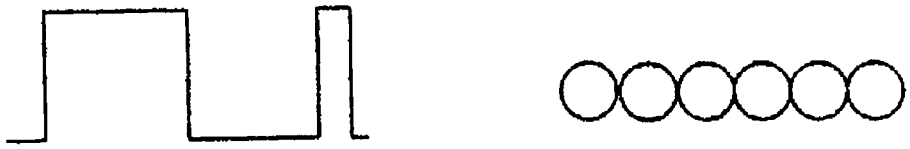
Figure 5:
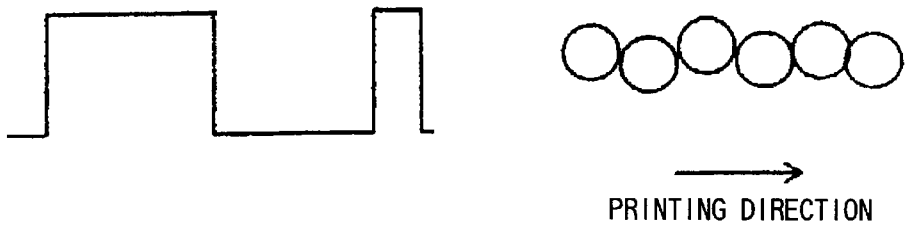

This selection process can be described in more detail with FIGS. 5(*a*) through 5(*d*). Ejection signals shown in FIGS. 5(*a*) through 5(*d*) consist of a primary pulse width, an auxiliary pulse width, and an interval between the two pulse widths that are all varied at a uniform proportion. In this example, the primary pulse width increases gradually larger in the order from FIG. 5(*a*) to FIG. 5(*d*). However, the plurality of preselected ejection signals can be varied according to many different methods. For example, two ejection signals can be selected for stabilizing the ejection direction of the ink droplet based on a maximum and minimum value within the tolerance range of the ink chambers, nozzle dimensions, and the like. A parameter such as pulse width that determines the properties of these ejection signals is varied at a uniform rate/proportion. Then, a plurality of suitable ejection signals are selected from among these variations.

In another variation, a plurality of ink jet print heads are randomly sampled from the same production line of ink jet print heads. Experiments are conducted to investigate a proper ejection signal needed to stabilize the ejection direction of the ink droplets, and a plurality of types of ejection signals are selected from among those determined in the experiments.

[Second Step]

Each ejection signal is applied to a given ink jet print head to determine which signal best stabilizes the ejection direction of each nozzle. This determination is made based on the amount of unevenness seen in dot arrays recorded on a recording medium. In FIGS. 5(*a*) through 5(*d*), the dot arrays recorded on the recording medium when applying ejection signals are shown to the right of each signal. In this example, the recording made by using ejection signal of FIG. 5(*c*) resulted in the straightest row of dots. Therefore, the direction in which ink is ejected from the nozzles when using ejection signal of FIG. 5(*c*) is determined to be stabilized. Thus, this ejection signal is selected as the ink jet print head ejection signal. The evenness of the dot array is determined by forming an image of the dots recorded on a recording medium using a CCD camera or the like and enlarging the image. Subsequently, the image can either be inspected visually or evaluated with a computer image processing program or the like.

[Third Step]

Data corresponding to the utilized ejection signal is stored in the ROM memory device 11, which is integrally formed on the ink jet print head 1. According to this process, the ink jet print head 1 ejects ink onto a recording medium as the carriage supporting the ink jet print head 1 is driven back and forth over the recording medium. During this process the ink jet print head 1 is controlled based on an optimal ejection signal. As a result, the direction in which ink is ejected from each of the ink jet print heads can be stabilized, thereby substantially maintaining a uniform recording quality.

Hence, even if variations exist in the dimensions of the ink chambers and nozzles and the like in the ink jet print head, it is possible to reduce the effects of these variations on the ejection aim by determining an ejection signal as described above. Accordingly, it is not necessary to require an unusually strict tolerance in the manufacturing process of the ink jet print head 1, thereby improving productivity and yieldability.

When the recording device is a multicolor device provided with a plurality of ink jet print heads 1, each ink jet print head 1 is adjusted using the method described above, and suitable ejection signals for each print head are stored in the ROM memory device 11. As a result, the printing of each ink jet print head 1 can be maintained at a uniform quality, and ink droplets of each color can be arrayed without any distortion to thereby provide accurate relative dot positions of different colors. Thus, the various colors will mix properly to achieve an accurate color recording.

While the invention has been described in detail with reference to specific embodiments thereof, it would be apparent to those skilled in the art that many modifications and variations may be made therein without departing from the spirit of the invention, the scope of which is defined by the attached claims.

For example, in the embodiment described above the present invention applies to an ink jet print head, wherein a voltage is applied to a piezoelectric element, causing the element to deform mechanically and eject ink from the ink chamber. However, the present invention can also be applied to the so-called Bubble-Jet type ink jet print head, which uses a heating element (zirconium boride or the like) to momentarily apply heat to ink in the ink chamber. The heat causes film boiling, which generates a bubble in the ink. The volume expansion in the ink caused by the expanding air bubble is utilized to force an ink droplet out of the ink chamber.

In the embodiment described above, the ink jet print head uses an ejection signal containing two electrical pulses (a primary pulse and an auxiliary pulse). However, it is obvious that the ink jet print head can also use an ejection signal having only one electrical pulse (a primary pulse) or a plurality of either the primary pulses or auxiliary pulses.

In the embodiment described above, the primary pulse and auxiliary pulse have the same wave height. However, it is also possible to use different wave heights for these two pulses to suit the size of the meniscus vibrations. Further, the waveform of the auxiliary pulse can be configured to fall when the meniscus recedes, in order to restrain the meniscus vibration by shrinking the capacity of the ink chamber, and to rise when the meniscus advances, in order to restrain the meniscus vibration by returning the ink chamber to its normal capacity.

What is claimed is:

1. A method for regulating ink droplet drive control in an ink jet print head wherein an ejection signal is applied to an actuator provided in the ink jet print head to eject ink stored in an ink chamber through an associated nozzle, the method comprising the steps of:

preparing a plurality of ejection signals each driving the ink jet print head under conditions different from each other;

driving the ink jet print head with each of the plurality of ejection signals, wherein dot arrays are formed on a recording medium as a result of ink ejection from the nozzle with respect to each ejection signal;

selecting one of the plurality of ejection signals to be a selected ejection signal, the selected ejection signal providing a more stable ink ejection direction from the allocated nozzle than the other ejection signals by determining distortion of the dot array in order to determine whether the aim of the ejection has been stabilized.

2. The regulating method as claimed in claim 1, wherein the determining step determines a linearity of the dot arrays, and selects the one of the ejection signals which most provides linearity of the dot array.

3. The regulating method as claimed in claim 1, wherein the actuator is provided on one side of the ink chamber for generating a pressure wave in the ink based on the ejection signal;

and wherein in the preparing step, the plurality of ejection signals are configured of pulse signals that differ in pulse width.

4. The regulating method as claimed in claim 3, wherein each of the plurality of ejection signals is a combination of a primary pulse and an auxiliary pulse, the primary pulse having pulse width different from each other, and an auxiliary pulse having a timing and a pulse width capable of substantially dampening meniscus vibrations caused by the primary pulse.

5. The regulating method as claimed in claim 4, wherein the plurality of ejection signals are configured by varying the primary pulse width, the auxiliary pulse width, and the interval between the two pulse widths, and the varying being made at a uniform proportion.

6. The regulating method as claimed in claim 1, wherein the ink jet print head integrally provides a memory device for storing data corresponding to the selected ejection signal.

7. An image recording device for forming an image on an image recording medium comprising:

an ink jet print head having an actuator to eject ink stored in an ink chamber through an associated nozzle, an ejection signal being applied to the actuator for the ink ejection; and a memory device provided to the ink jet print head and storing therein data corresponding to a selected ejection signal for providing the most stabilized ink ejecting direction from the associated nozzle.

8. The image recording device as claimed in claim 7, wherein the selected ejection signal is determined by preparing a plurality of ejection signals each driving the ink jet print head under conditions different from each other;

driving the ink jet print head with each of the plurality of ejection signals, wherein dot arrays are formed on a recording medium as a result of ink ejection from the nozzle with respect to each ejection signal;

selecting one of the plurality of ejection signals, to be a selected ejection signal, the selected ejection signal providing a more stable ink ejection direction from the allocated nozzle than the other ejection signals by determining distortion of the dot array in order to determine whether the aim of the ejection has been stabilized.

9. A multi-color image recording device for forming an image on an image recording medium comprising:

a plurality of ink jet print heads each having an actuator to eject ink stored in an ink chamber through an associated nozzle, an ejection signal being applied to each actuator for the ink ejection, the plurality of ink jet print heads ejecting inks of colors different from each other, and a plurality of memory device each provided to each ink jet print head, each memory device storing therein data corresponding to a selected ejection signal associated with each ink jet print head for providing the most stabilized ink ejecting direction from the associated nozzle.

10. The multicolor image recording device as claimed in claim 9, wherein each of the selected ejection signals is determined by preparing a plurality of ejection signals each driving each ink jet print head under conditions different from each other;

driving each ink jet print head with each of the plurality of ejection signals, wherein dot arrays are formed on a recording medium as a result of ink ejection from the nozzle with respect to each ejection signal;

selecting one of the plurality of ejection signals, to be a selected ejection signal, the selected ejection signal providing a more stable ink ejection direction from the allocated than the other ejection signals by determining distortion of the dot array in order to determine whether the aim of the ejection has been stabilized.

* * * * *